US007163591B2

(12) United States Patent
Kim et al.

(10) Patent No.: US 7,163,591 B2
(45) Date of Patent: Jan. 16, 2007

(54) METHOD OF PREPARING MICRO-STRUCTURED POWDER FOR BONDED MAGNETS HAVING HIGH COERCIVITY AND MAGNET POWDER PREPARED BY THE SAME

(75) Inventors: Andrew S. Kim, Cheongju-si (KR); Seok Namkung, Incheon Metropolitan (KR); Dong-Hwan Kim, Cheongju-si (KR)

(73) Assignee: Jahwa Electronics Co., Ltd. (KR)

( * ) Notice: Subject to any disclaimer, the term of this patent is extended or adjusted under 35 U.S.C. 154(b) by 395 days.

(21) Appl. No.: 10/734,544

(22) Filed: Dec. 12, 2003

(65) Prior Publication Data

US 2005/0081959 A1 Apr. 21, 2005

(30) Foreign Application Priority Data

Oct. 15, 2003 (KR) ..... 10-2003-0071765

(51) Int. Cl.
*H01F 1/053* (2006.01)
*H01F 1/057* (2006.01)

(52) U.S. Cl. ..... 148/101; 148/104; 419/12

(58) Field of Classification Search ..... None
See application file for complete search history.

(56) References Cited

U.S. PATENT DOCUMENTS 5,858,124 A * 1/1999 Endo et al. ..... 148/302
2003/0047240 A1* 3/2003 Honkura et al. ..... 148/105
2003/0106615 A1* 6/2003 Hirota et al. ..... 148/101

FOREIGN PATENT DOCUMENTS

JP 6-231925 * 6/1994

* cited by examiner

*Primary Examiner*—John P. Sheehan
(74) *Attorney, Agent, or Firm*—Daniel P. Burke & Associates, PLLC

(57) ABSTRACT

Disclosed is a method of preparing a micro-structured powder for bonded magnets having high coercivity, which is advantageous in terms of low preparation costs by recycling magnet scraps, simplified mass production, minimal environmental contamination by such a recycling process, and the preparation of stable anisotropic powders having high coercivity. Further, a magnet powder prepared by the above method is provided. The current method is characterized in that R—Fe—B type anisotropic sintered magnets or scraps thereof are crushed to prepare 50–500 μm sized magnet powders, which are then mixed with 1–10 wt % of rare earth fluoride ($RF_3$) powders and thermally treated at high temperatures (500–1100° C.) in a vacuum or an inert gas, to cause the change of matrix-near surface and grain boundary of the powders. Thus obtained powders include a matrix phase having $R_2Fe_{14}B$ crystal structure, a R-rich grain boundary phase containing rare earth fluoride, and other phases, in which the matrix phase has an average grain size of 1–20 μm, and the powders have an average size of 50–500 μm with superior magnetic characteristics of (BH)max≧20 MGOe and iHc≧5 kOe.

3 Claims, 6 Drawing Sheets

METHOD OF PREPARING MICRO-STRUCTURED POWDER FOR BONDED MAGNETS HAVING HIGH COERCIVITY AND MAGNET POWDER PREPARED BY THE SAME

BACKGROUND OF THE INVENTION

1. Field of the Invention

The present invention relates, generally, to methods of preparing micro-structured R—Fe—B type anisotropic powders for bonded magnets having high coercivity and thus prepared magnet powders. More specifically, the present invention relates to a method of preparing a micro-structured powder for bonded magnets having high coercivity, characterized in that R—Fe—B type anisotropic sintered magnets or scraps thereof are crushed to prepare 50–500 μm sized magnet powders, which are then mixed with 1–10 wt % of rare earth fluoride ($RF_3$) powders and thermally treated at high temperatures (500–1100° C.) in a vacuum or an inert gas, to cause the change of the matrix-near surface and grain boundary of the powders, thereby exhibiting advantages of low preparation costs by recycling magnet scraps, simplified mass production, minimal environmental contamination by such a recycling process, and the preparation of stable anisotropic powders having high coercivity. Further, a recycling process of the magnet scraps is efficiently improved, resulting in increased productivity and reliability. In addition, a micro-structured powder for bonded magnets having high coercivity prepared by the above method is provided.

2. Description of the Related Art

In general, R—Fe—B (Nd—Fe—B) type magnets developed already have high magnetic characteristics, and are employed to decrease the size of electric and electronic products. Further, the R—Fe—B type magnets have high performance and thus applications thereof become wide.

Powders for the R—Fe—B type magnets are classified into nano-structured isotropic powders using a melt spinning process, and anisotropic powders by use of an HDDR (Hydrogen Disproportionation Desorption Recombination) process.

As the above applications of the R—Fe—B type magnets, there are high-powered motor products, such as VCRs laser printers, hard disk drives, robots, electric power steering, automobile fuel pumps, washing machines, refrigerators, and air conditioners, speakers, buzzers, sensors, and magnetic gears. As well, the above magnet can function to realize small sizes and energy-saving of end products, and thus applied for digital cameras, camcorders, office machines, etc.

Although greater convenience has been attributed to the development of such electronic products, wastes thereof increase, thus generating serious environmental contamination.

Therefore, research on recycling the collected wastes is thoroughly under studying. In particular, with the intention of recycling Nd—Fe—B type magnet scraps, rare earth elements may be extracted therefrom, or the magnet scraps may be re-melted or converted to resin magnets.

However, an extracting process of rare earth elements from the Nd—Fe—B type magnet scraps suffers from being complicated, and requires high extracting costs. Further, a re-melting process is complicated, with recovery efficiency less than 50%, due to the high oxygen concentration of the magnets and oxidation during the recycling process. Thus, the above processes have no economic benefits, and most magnet scraps are buried.

Hence, since limitations are imposed on efficiencies of conventional recycling processes for magnet scraps, productivity and reliability are decreased.

Of commercially available magnetic powders, isotropic powders prepared by a melt spinning process as a rapid solidification process are suitable for use in the preparation of resin magnets. However, such isotropic powders have low magnetic characteristics and are expensive, and thus limited in application fields. Meanwhile, although the HDDR powders are anisotropic and thus have high magnetic characteristics, they are disadvantageous in terms of high preparation costs, and difficulty in the preparation on a large scale.

SUMMARY OF THE INVENTION

Accordingly, the object of the present invention is to alleviate the problems encountered in the related art and to provide a method of preparing a micro-structured powder for bonded magnets having high coercivity, which is advantageous in terms of low preparation costs by recycling magnet scraps, simplified mass production, minimal environmental contamination by such a recycling process, and the preparation of stable anisotropic powders having high coercivity. Further, a recycling process of the magnet scraps are efficiently improved, thus further increasing productivity and reliability.

Another object of the present invention is to provide a micro-structured powder for bonded magnets having high coercivity prepared by the above method.

To achieve the above objects, the present invention provides a method of preparing R—Fe—B anisotropic permanent magent powders, characterized in that R—Fe—B type anisotropic sintered magnets or scraps thereof are crushed to prepare magnet powders having an average size of 50–500 μm, which are then mixed with 1–10 wt % of rare earth fluoride ($RF_3$) powders and thermally treated at high temperatures (500–1100° C.) in a vacuum or an inert gas, to cause the change of matrix-near surface and grain boundary of the powders. Thus prepared powders include a matrix phase having $R_2Fe_{14}B$ crystal structure, a R-rich grain boundary phase containing rare earth fluoride, and other phases, in which the matrix phase has an average grain size of 1–20 μm, and the powders have an average size of 50–500 μm with superior magnetic characteristics of (BH)max≧20 MGOe and iHc≧5 kOe.

BRIEF DESCRIPTION OF THE DRAWING

The above and other objects, features and other advantages of the present invention will be better understood from the following detailed description taken in conjunction with the accompanying drawing, in which.

DETAILED DESCRIPTION OF THE INVENTION

Figure 1:
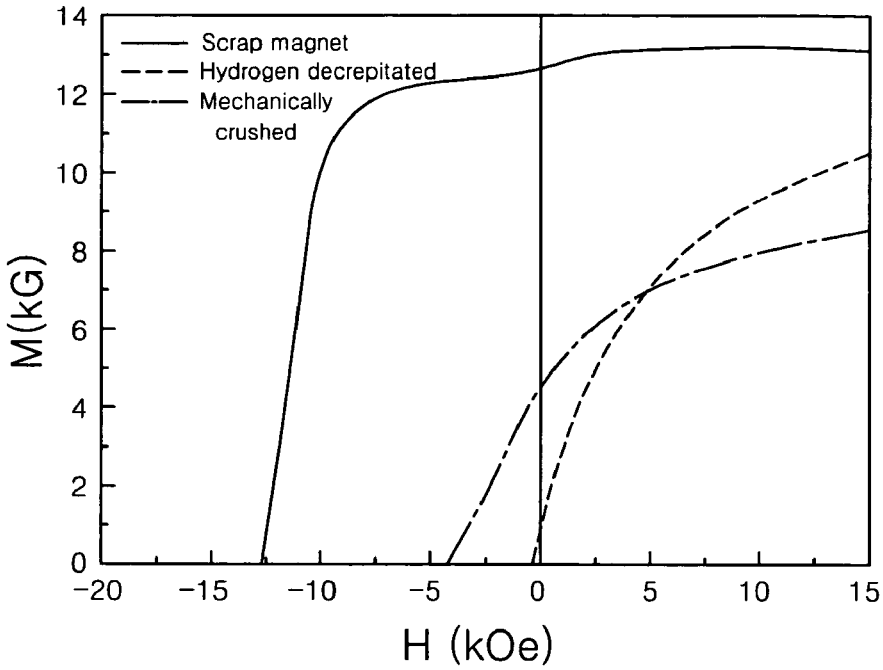
FIG. 1 is a demagnetization curve showing magnetic characteristics of mechanically crushed (MC) magnet powders and hydrogen decrepitated (HD) magnet powders for an Nd—Fe—B type sintered magnet.

In the present invention, a specific description for the related techniques or structures is considered to be unnecessary and thus is omitted.

Further, it should be understood that the terminology used therein may be changed according to the intention or purpose of producers and manufacturers, and definition thereof is based on the description of the present invention.

In the present invention, a preparation method of R—Fe—B type anisotropic permanent magnet powders is provided, which comprises (a) mechanically crushing or hydrogen decrepitating a R—Fe—B type anisotropic sintered magnet or scraps thereof, to prepare 50–500 μm sized R—Fe—B type anisotropic permanent magnet powders, (b) mixing the R—Fe—B type anisotropic permanent magnet powders with 1–10 wt % of rare earth fluoride ($RF_3$) powders having a size of 0.1–50 μm, to obtain mixed powders, and (c) thermally treating the mixed powders at 500–1100° C. in a vacuum or an inert gas atmosphere.

As for the step (a), the scraps of the R—Fe—B type anisotropic sintered magnet are crushed so as for recycling and thus environmentally friendly.

Then, in the step (b), the scraps of the R—Fe—B type anisotropic sintered magnet crushed so as for recycling and environmental protection are mixed with rare earth fluoride, such as $NdF_3$, $PrF_3$, $DyF_3$, and $TbF_3$.

In such a case, the anisotropic sintered magnet to be crushed has 1–20 μm sized grains, which are not a nanostructure corresponding to the size less than 1 μm and also are not in the state of being over-sintered exceeding 20 μm causing the problems, such as degraded magnetic characteristics. Further, the above anisotropic sintered magnet includes 30–40 wt % of R (rare earth element), 0.8–1.5 wt % of B, 0–20 wt % of Co and 0.1–5.0 wt % of at least one element selected from among Al, Ga, Cu, Sn, Nb, V, Zr or F, with the balance being Fe and inevitable impurities, as in Nd—Fe—B type sintered magnets.

After the sintered magnet is crushed, resultant permanent magnet powders have the components and the size of grains same as the above sintered magnet, in which the crushed powders have an average size of 50–500 μm. If the powders are smaller than 50 μm, the magnetic characteristics decrease. Whereas, if they are larger than 500 μm, such magnet powders are unsuitable for use in a resin magnet.

As for the step (b), preference is given to using the additive not more than 10 wt %. If the additive is used in the amount larger than 10 wt %, a residual magnetization value and (BH)max are lowered.

The mixed powders are thermally treated in the step (c). Upon the thermal treatment, the magnetic characteristics begin to increase at 500° C. and reach the maximum level at 800–1000° C. At the sintering temperatures of 1100° C. or higher, the magnetic characteristics are degraded. The thermally treated powders include rare earth fluoride, in which the rare earth element is contained in the larger amount on the surface portion of the grain.

Thus prepared R—Fe—B type anisotropic permanent magnet powders, which are micro-structured composite powders, include a matrix phase having intermetallic compounds, $R_2Fe_{14}B$, of a tetragonal crystal structure, and a grain boundary phase having a R—Fe eutectic phase and R-fluoride as a R-rich phase. Particularly, each grain of the powders has the large amount of the rare earth element on the surface thereof.

In addition, the R—Fe—B type anisotropic permanent magnet powders have the grains with an average size of 1–20 μm.

As mentioned above, the sintered magnet has 1–20 μm sized grains. If the grains have the size smaller than 1 μm or exceeding 20 μm, the sintered magnet has decreased magnetic characteristics. Since such a sintered magnet is crushed, the magnet powders have the grains with an average size of 1–20 μm.

The R—Fe—B type anisotropic permanent magnet powders have an average size of 50–500 μm.

If the powders are larger than 500 μm, it is difficult to prepare a resin magnet using the above powders. Meanwhile, if they are smaller than 50 μm, the magnet powders have low magnetic characteristics and thus are unsuitable for use in the resin magnet.

The R—Fe—B type anisotropic permanent magnet powders have magnetic characteristics of an energy product {(BH)max} not less than 20 MGOe, and a coercivity (iHc) not less than 5 kOe.

When the energy product is not less than 20 MGOe, the R—Fe—B type anisotropic magnet is regarded to be superior to an isotropic resin magnet, and has magnetic characteristics closer to those of the resin magnet prepared using the HDDR powders. For this, the coercivity should be maintained in the level of at least 5 kOe.

Thereby, the scraps of the sintered magnet are crushed, to obtain the R—Fe—B type anisotropic permanent magnet powders having the above magnetic characteristics, from which the anisotropic resin magnet can be prepared.

Thus obtained powders include a matrix phase of $R_2Fe_{14}B$ crystal structure, a R-rich grain boundary phase containing R-fluoride, and other phases. As such, the matrix phase has an average grain size of 1–20 μm, and the powders have an average size of 50–500 μm. The magnetic characteristics of the powders are represented by high energy product of (BH)max≧20 MGOe and high coercivity of iHc≧5 kOe.

Hereinafter, a detailed description will be given of the present invention, with reference to the appended drawings.

The Nd—Fe—B type sintered magnet has high magnetic characteristics. However, as shown in FIG. 1, when the above Nd—Fe—B type sintered magnet is mechanically crushed (MC) or hydrogen decrepitated (HD), they have drastically decreased magnetic characteristics.

That is, since only crushed magnet powders are impossible to be used as powders for the resin magnet, thermal treatment should be performed to restore the coercivity of the crushed magnet powders.

Figure 2:
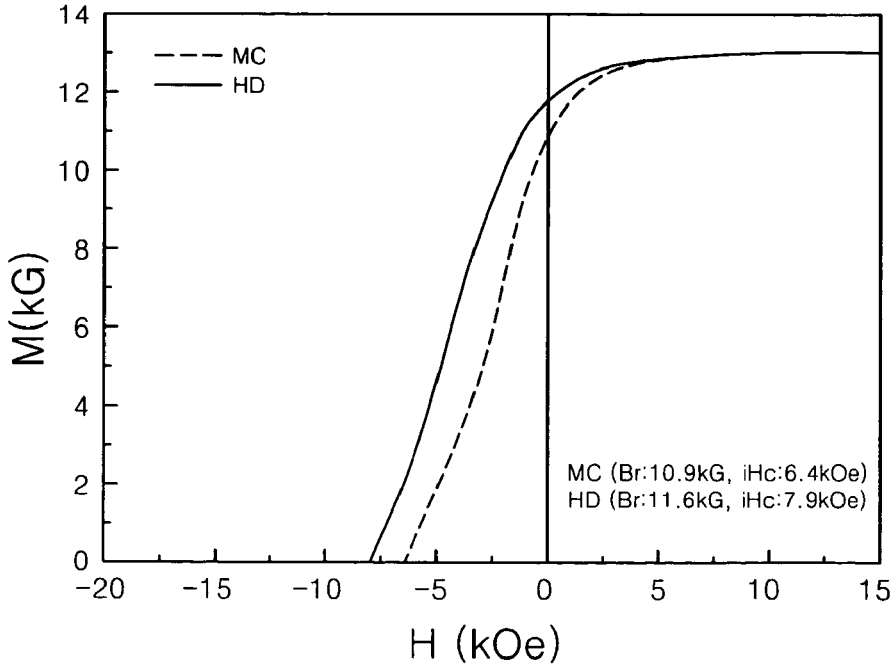
FIG. 2 is a demagnetization curve showing magnetic characteristics of the MC magnet powders and the HD magnet powders after thermal treatment at 1000° C. for 2 hours.

The thermal treatment is performed in a vacuum to extract hydrogen of the HD powders. As such, the coercivity is the highest at 1000° C. FIG. 2 shows a demagnetization curve of the crushed powders after the thermal treatment, in which the HD powders have the coercivity higher than that of the MC powders. However, the magnetic characteristics of the thermally treated powders shown in FIG. 2 are lower than those of the sintered magnet of FIG. 1.

Figure 3:
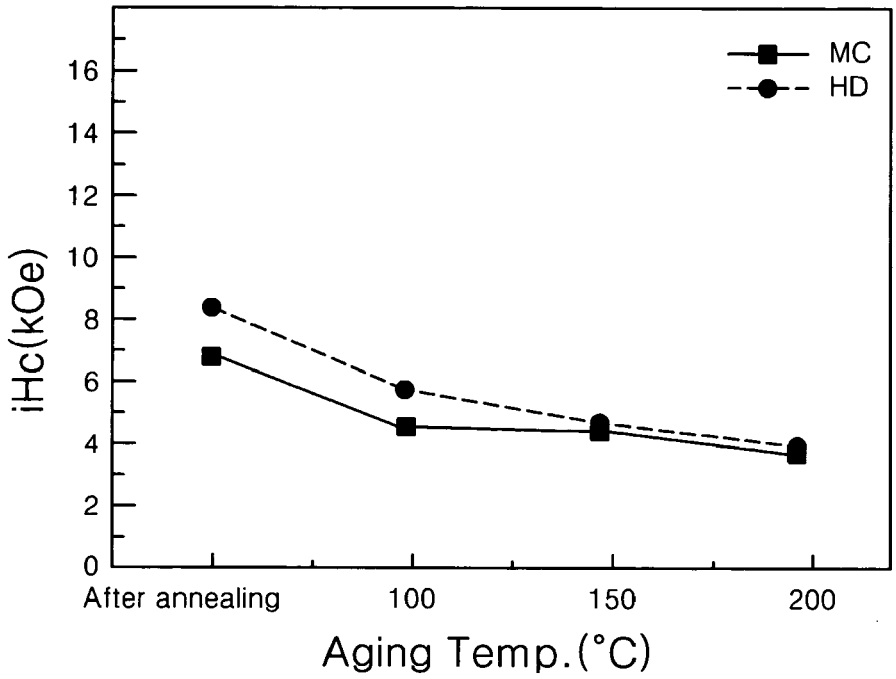
FIG. 3 is a graph showing a coercivity according to aging temperatures of the MC magnet powders and the HD magnet powders after the thermal treatment.

To prepare the resin magnet, a curing process following a compacting process should be carried out at 150–200° C. In such a case, with the aim of using the prepared powders as the resin magnet powders, whether the magnetic characteristics are decreased at the temperature zone required for the curing process is confirmed, and also, the requirement of iHc>½ Br should be satisfied. From FIG. 3, it can be seen that the coercivity is not completely restored by the thermal treatment, since the above requirement is not satisfied. Thus, the powders shown in FIG. 3 are unsuitable for use in the resin magnet.

Figure 4:
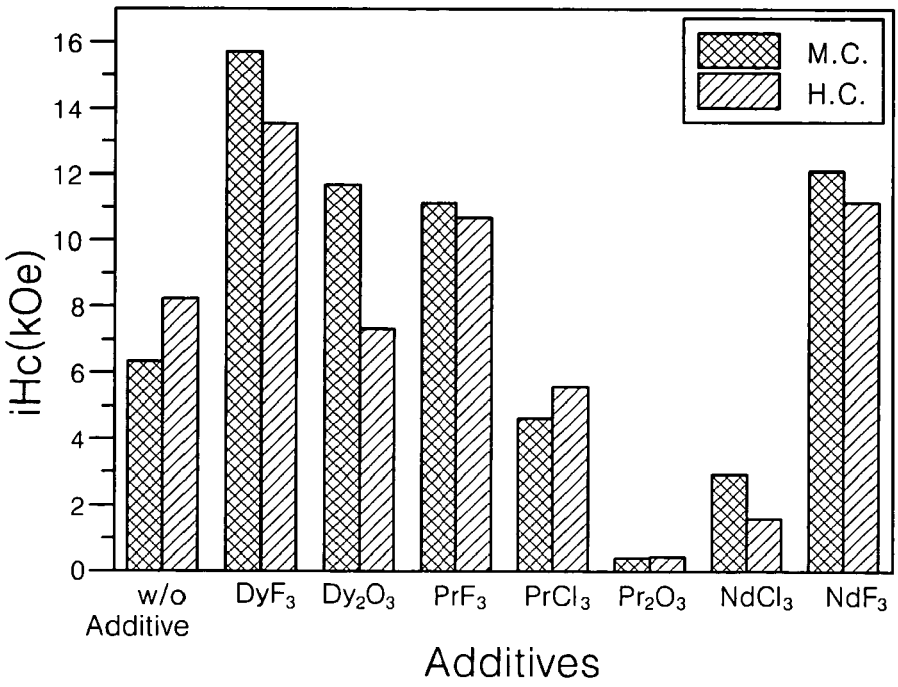
FIG. 4 is a histogram showing a coercivity of the MC magnet powders and the HD magnet powders after a surface additive is added.

Therefore, an additive is used to restore the coercivity to be close to the magnetic characteristics of the sintered magnet. As in FIG. 4, the coercivity of the thermally treated powders including various additives is shown. In cases of using R-fluoride ($DyF_3$, $NdF_3$, $PrF_3$) as the additive, the coercivity has a greater increase, compared to cases without the additive. However, oxides and chlorides have a negative influence on the coercivity.

Of the rare earth fluorides, $NdF_3$ functions to increase the values of Br and (BH)max after the thermal treatment, and $DyF_3$ acts to maximize the value of iHc.

Further, when the additive is not used, the HD powders have the coercivity higher than that of the MC powders. However, in the MC powders and the HD powders each mixed with $DyF_3$ powders, the coercivity of the MC powders is the highest.

Figure 5:
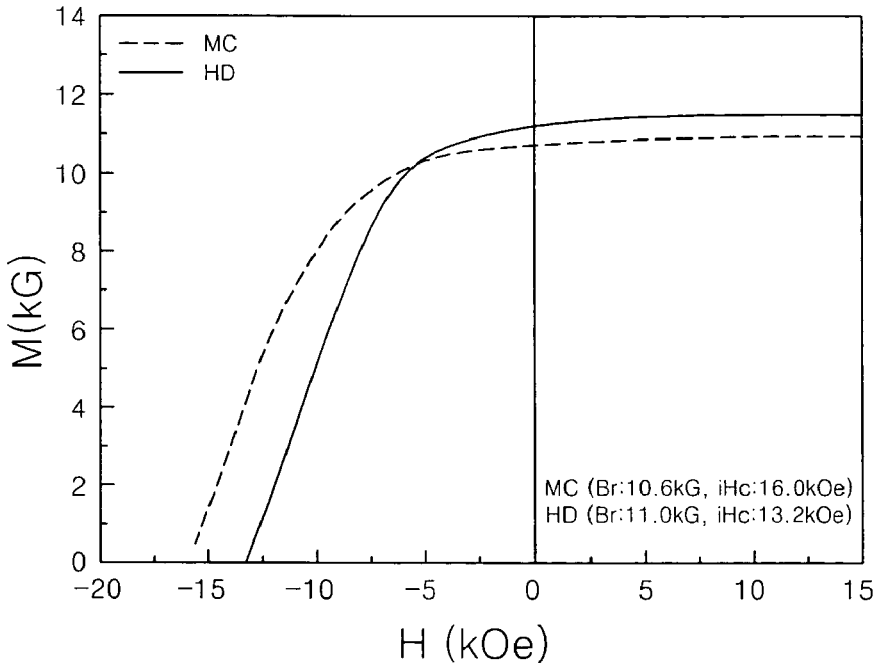
FIG. 5 is a demagnetization curve showing magnetic characteristics of the MC powders and the HD powders each mixed with $DyF_3$ and then thermally treated.

Turning now to FIG. 5, there is shown a demagnetization curve after the MC powders and the HD powders each having 5 wt % of $DyF_3$ are thermally treated. From the results of FIG. 5, it can be seen that the magnetic characteristics of the thermally treated powders having the additive are remarkably enhanced, and in particular, the coercivity thereof is similar to that of the sintered magnet of FIG. 1, compared to the demagnetization curve containing no additive of FIG. 2.

Figure 6A:
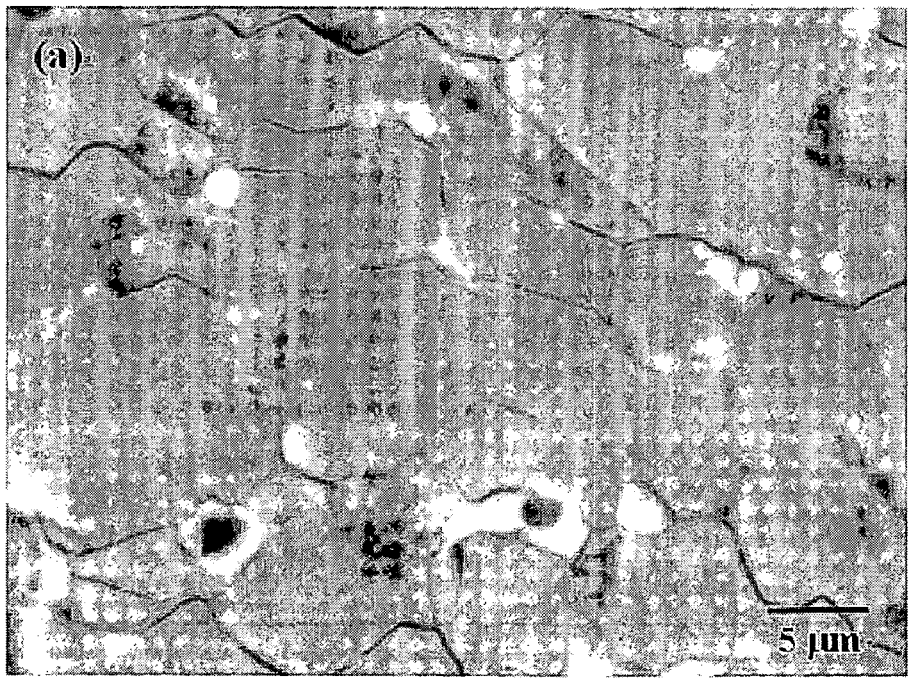
FIGS. 6*a* and 6*b* are scanning electron micrographs showing sections of the HD powders before and after the thermal treatment, respectively.
Figure 6B:
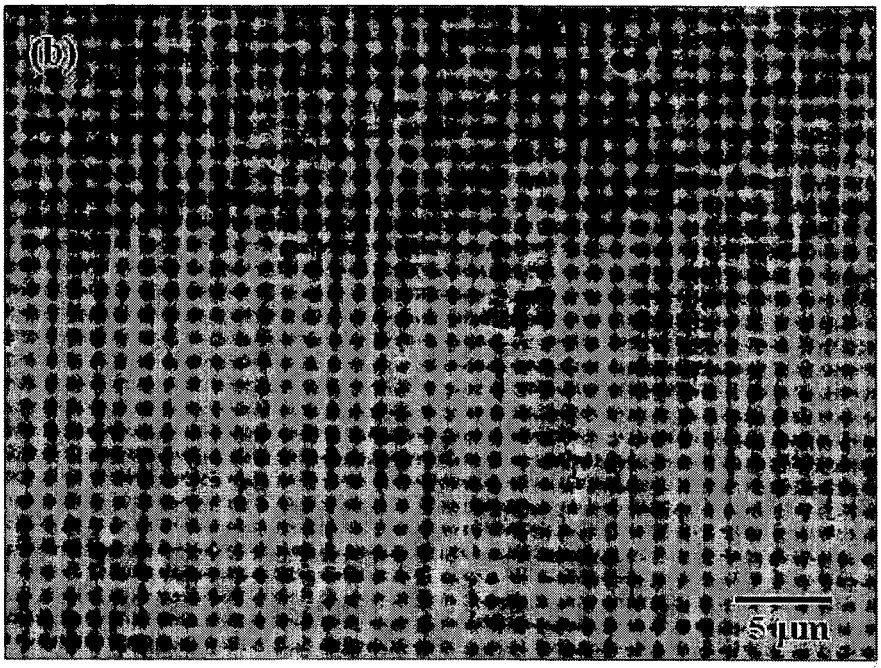

To confirm the change by thermal treatment, the sections of the HD powders before and after the thermal treatment are observed by a scanning electron microscope (SEM), and the results are shown in FIGS. 6*a* and 6*b*. The HD powders without the additive have less cracks after the thermal treatment (FIG. 6*b*), compared to before the thermal treatment of FIG. 6*a*.

Figure 7:
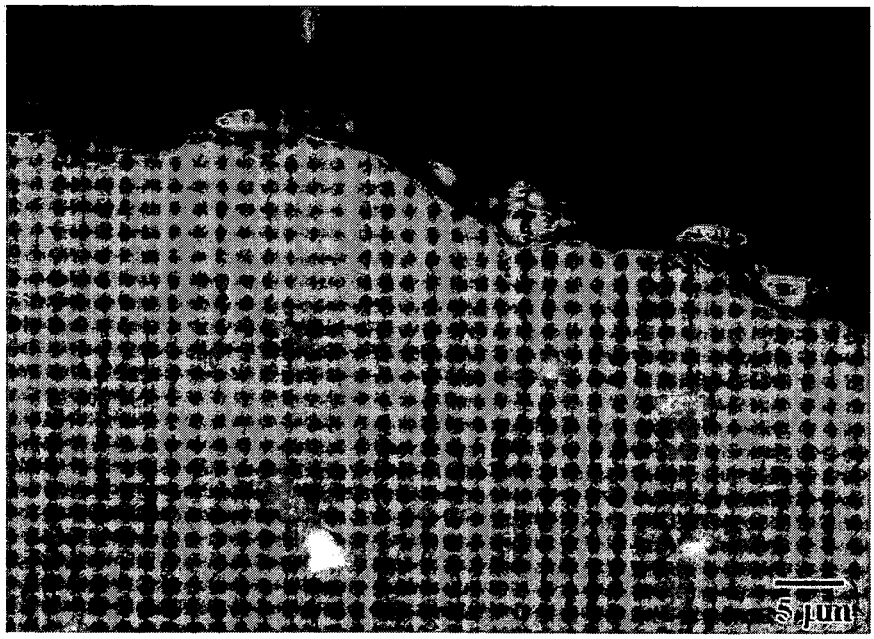
FIG. 7 is a scanning electron micrograph showing a section of the MC powders mixed with $DyF_3$ and then thermally treated.

As shown in FIG. 7, in cases of the thermally treated MC powders containing $DyF_3$, the edge portion of the powder section, that is, the matrix-near surface of the powders, is slightly curving, which means the exhibition of restoring effects. From this, it can be found that the coercivity increases by the changes inside and outside the powders.

In FIG. 7, two phases showing white and grey as the R-rich grain boundary phase are shown.

Figure 8A:
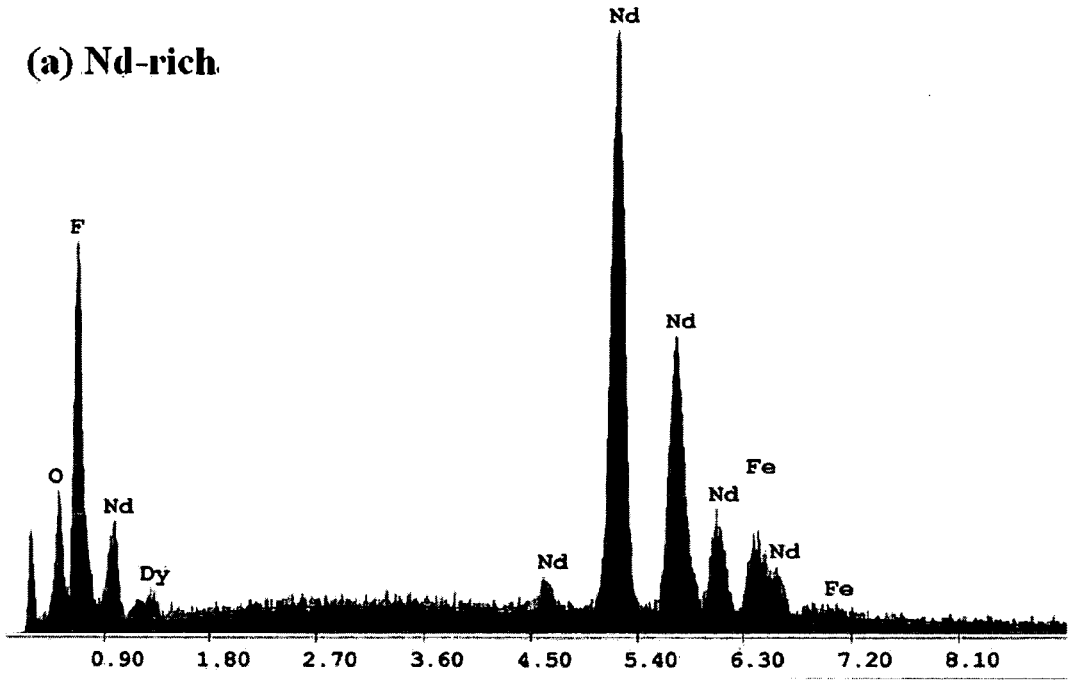
FIGS. 8*a* and 8*b* are graphs showing EDS analytic results of an Nd-rich phase and a matrix-near surface of the MC powders mixed with $DyF_3$ and then thermally treated, respectively.
Figure 8B:
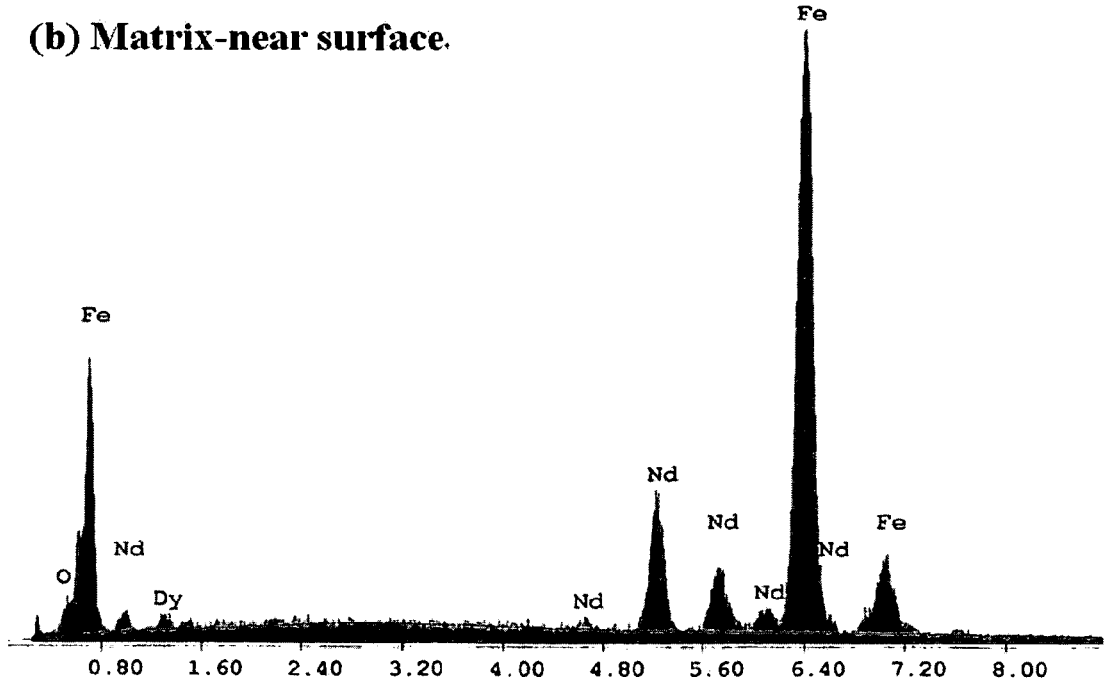

That is, as in FIG. 8*a*, the grey Nd-rich phase has the highest peaks of Nd and F. Further, as in FIG. 8*b*, the peaks of Dy, Nd and Fe are high on the matrix-near surface portion. This is because $DyF_3$ is decomposed to Dy and F when thermally treated, and F is dispersed through the grain boundary to form Nd fluoride, while Dy is dispersed to the surface of the grain to increase the amount of Dy on the surface portion.

The modification of the grain surface and the change of the grain boundary act to inhibit reverse domain nucleation, thus restoring the coercivity.

Figure 9:
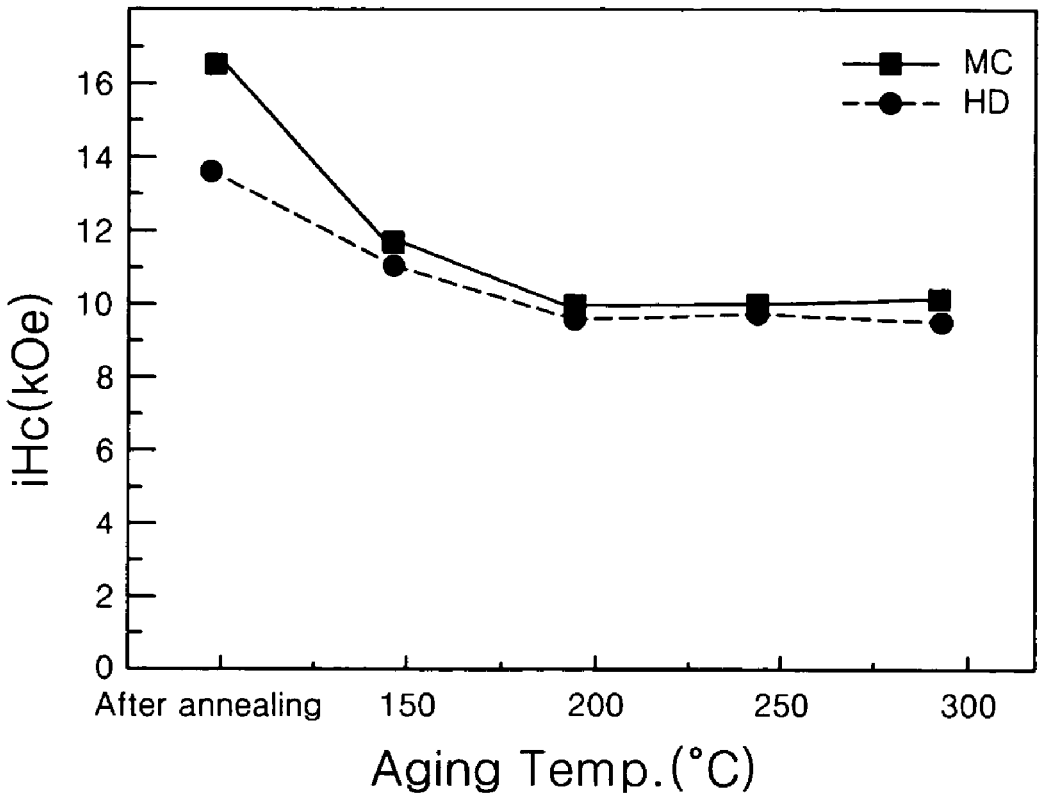
FIG. 9 is a graph showing a coercivity according to aging temperatures of the MC powders and the HD powders each mixed with $DyF_3$ and then thermally treated.

FIG. 9 shows the result of thermal stability for the MC powders and the HD powders each mixed with $DyF_3$ and then thermally treated. Although the coercivity is slightly decreased according to aging temperatures, the coercivity is maintained in the level of 9–10 kOe, which is a value much higher than that of the thermally treated powders containing no additive. In addition, the requirement of iHc>½ Br is satisfied, and thus the powders are suitable for use in the resin magnet powders having superior magnetic characteristics.

Consequently, the scraps of the R—Fe—B type sintered magnet are crushed, mixed with rare earth fluoride, and then thermally treated, thereby obtaining the resin magnet powders having high coercivity. The above method shows that the stable anisotropic powders having high coercivity are prepared at low costs. Further, since the R—Fe—B type sintered magnet scraps are recycled to obtain the resin magnet powders, environmental protection is achieved.

As described above, the present invention provides a method of preparing a micro-structured powder for bonded magnets having high coercivity and a magnet powder prepared by the same. The method of the present invention is advantageous in terms of low preparation costs by recycling the magnet scraps, simplified mass production, minimal environmental contamination by such a recycling process, and the preparation of stable anisotropic powders having high coercivity. Moreover, recycling efficiencies for the magnet scraps are improved, whereby productivity and reliability can be further increased.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of preparing a micro-structured powder for bonded magnets having high coercivity, comprising:

(a) mechanically crushing or hydrogen decrepitating a R—Fe—B type anisotropic sintered magnet or scraps thereof, to prepare R—Fe—B type anisotropic permanent magnet powders having an average size of 50–500 μm;

(b) mixing the R—Fe—B type anisotropic permanent magnet powders with 1–10 wt % of rare earth fluoride ($RF_3$) powders having a size of 0.1–50 μm, to obtain mixed powders; and (c) thermally treating the mixed powders at 500–1100° C. in a vacuum or an inert gas atmosphere, to prepare R—Fe—B type anisotropic permanent magnet powders.

2. The method as defined in claim 1, wherein the step (a) is performed by crushing the scraps of the R—Fe—B type anisotropic sintered magnet to recycle magnet scraps and protect environment.

3. The method as defined in claim 2, wherein the scraps of the R—Fe—B type anisotropic sintered magnet are crushed to recycle magnet scraps and protect environment, and then mixed with any fluoride selected from among $NdF_3$, $PrF_3$, $DyF_3$ and $TbF_3$ by the step (b).

* * * * *